United States Patent [19]

Lowell

[11] Patent Number: 4,494,884

[45] Date of Patent: Jan. 22, 1985

[54] SPOKED MULTIPLE-WHEEL PRINTER

[76] Inventor: Herman H. Lowell, P.O. Box 3128, Silver Spring, Md. 20901

[21] Appl. No.: 439,274

[22] Filed: Nov. 4, 1982

[51] Int. Cl.[3] ..... B41J 1/30

[52] U.S. Cl. ..... 400/144.2; 400/82

[58] Field of Search ..... 400/144, 144.1, 144.2, 400/144.3, 144.4, 149, 150, 151, 151.1, 82; 178/35, 38, 39, 40

[56] References Cited

U.S. PATENT DOCUMENTS

| | | | |
|---|---|---|---|
| 317,371 | 5/1885 | Kaley | 400/144.2 |
| 1,994,431 | 3/1935 | May | 101/110 |
| 3,356,199 | 12/1967 | Robinson | 400/157 |
| 4,026,403 | 5/1977 | Inose et al. | 400/144.2 |
| 4,044,880 | 8/1977 | Martin | 400/82 |
| 4,106,611 | 8/1978 | Suzuki et al. | 400/144.2 |
| 4,197,022 | 4/1980 | Dollenmayer | 400/149 |
| 4,204,779 | 5/1980 | Lee et al. | 400/144.2 |
| 4,324,498 | 4/1982 | Steinhardt | 400/144.2 |
| 4,357,115 | 11/1982 | Or | 400/144.2 |

FOREIGN PATENT DOCUMENTS

| | | | |
|---|---|---|---|
| 3021340 | 12/1981 | Fed. Rep. of Germany | 400/144.2 |
| 137179 | 8/1982 | Japan | 400/144.2 |
| 537245 | 12/1976 | U.S.S.R. | 400/163 |

OTHER PUBLICATIONS

E. Degge; *Xerox Disclosure Journal;* "Multiple Type Wheel Printer"; vol. 1, No. 2; Feb. 1976, p. 49.

D. E. Braun; *Xerox Disclosure Journal;* "Impact Printer W/Dual On-Line Wheels; vol. 1, No. 11/12; Nov./-Dec. 1976, p. 35.

*Primary Examiner*—Paul T. Sewell

*Assistant Examiner*—David A. Wiecking

*Attorney, Agent, or Firm*—Dennison, Meserole, Pollack & Scheiner

[57] ABSTRACT

A high-speed printer with two or more individually driven, coordinately controlled, co-printing wheels carrying type elements supported by radial spokes or petals. One or more circumferential gaps (spoke-free positions) in each wheel permit read-through and hammer action or ribbon-impacting printing spoke deflection through print cycle instantaneously inactive wheel(s). The redistribution of symbols among a plurality of wheels, major reduction in size and moment of inertia of each wheel and drive motor, redundant wheel openings and redundant symbols distributed among the wheels greatly increase operating speed, materially assisted by microprocessor optimal lookahead wheel, opening and symbol preselection.

19 Claims, 6 Drawing Figures

SPOKED MULTIPLE-WHEEL PRINTER

BACKGROUND OF THE INVENTION

1. Field

This invention relates to a spoked print wheel serial printer or typewriter having a speed higher than that known in the prior art, and more particularly to one having plural independently driven but cooperatively controlled spoked print wheels with, generally, plural open positions around wheel circumferences, possibly redundant symbol spokes, and a single print hammer per wheel configuration.

2. Description of the Prior Art

Prior art serial printers have included those incorporating spoked wheel print elements, commonly called daisy wheels. Each printer has been equipped with usually one and in a few instances two wheels. Where two wheels have been used, particularly in wide-carriage machines, the wheels can print independently but they cannot be simultaneously active in the same portion of the print line. Usually, at least a substantial part of the full line span is inaccessible to one or the other of the wheels.

The wheels themselves have been variously constructed—reference U.S. Pat. Nos. 4,069,907; 4,106,611; and 4,126,400, for example. Until recently, however, despite the elaborations of hub and spoke arrangements, single-printposition mechanisms described were, in reality, single-wheel units, since all spokes and hubs rotated together and are driven by a single motor. Moreover, all wheel assemblies have been, roughly, of the same overall diameter—about 3" (except for Ricoh 2.4" biplanar wheels), and have, typically, carried between 88 and 96 printing spokes (sometimes called "arms", "beams", "fingers", "laminae", "petals", or "tongues"). Ricoh wheels have 64 spokes, each generally, carrying two symbols. Many of the units described in the patent literature and elsewhere have in fact been heavier and had higher polar moments of inertia than the more simple wheels they were supposed to supersede.

U.S. Pat. No. 4,197,022 to Dollenmayer, however, describes a dual-wheel unit differing markedly from prior configurations. The wheels are coaxially mounted and driven alternately by a single motor. For some relatively protracted period, one wheel is active and is driven through a clutch arrangement by the motor. At the end of a short or long sequence of symbols (the words "characters" and "symbols" are used here interchangeably), the entire wheel assembly is shifted axially by an auxiliary mechanism so as to bring the second wheel into the driven, effective printing position. The second wheel now lies in the printing plane previously occupied by the first wheel. A new sequence of symbols is selected from the second wheel, at which time the axial shift is reversed and the original wheel is again active in the same printing plane. This structure, while providing nearly a doubled set of symbols, in contrast to the 88 to 124 usually provided by a single wheel, contemplates the use of essentially standard wheels having conventional dimensions, numbers of spokes, weights, and polar moments of inertia. A minor modification, the provision of a single auxiliary angular opening in each wheel, is required to provide either clearance from obstructions, including the platen itself, for the wheel closer to the platen, when that wheel is inactive; or, in the case of the wheel closer to the hammer, clearance for hammer action when the latter wheel is inactive.

The sole advantage of the entire arrangement in Dollenmayer is the greatly expanded symbol set. If the symbols of both wheels are freely used, a very substantial speed diminution will result. At best, the net operating speed will always be less than the conventional.

In contrast, if instead of a nearly doubled character set, it is desired to greatly increase printing speed, with a more modest increase in the number of characters, in a machine having a carriage of any length whatever, it is necessary in some manner to greatly decrease the size, weight and, most importantly, polar moment of inertia of each of two or more wheels, each with its own smaller, faster, driving motor, to arrange for their non-interfering co-action, and to distribute the symbols so as to minimize required wheel rotations.

OBJECTS OF THE INVENTION

Accordingly, it is a primay object of this invention to greatly increase, by factors of 1.8 or more, the average printing speed beyond the usual roughly 45–55 symbols per second in a printer of normal carriage length. A minimum speed of about 80 per second is projected per wheel configuration.

Another object of the invention is to provide a plurality of print wheels per configuration, each of which is driven by its own motor, and all of which can print, alternately but cooperatively, in the same carriage area at any given time.

A yet further object of the invention is to provide wheels considerably smaller and lighter and of far smaller polar moment of inertia than conventional wheels, enabling the achievement of much higher angular accelerations and velocities.

Another object of the invention is to so configure the wheels, including angular openings and mechanical characteristics of the spokes, that mutual interference of hammer, spokes and wheels will not occur when proper microprocessor control is maintained.

A still further object of the invention is to gain further speed by minimization of the required angular positioning times of the several wheels through optimized distribution of symbols, some possibly redundant, among the wheels and provision, generally, of plural openings per wheel, optimally distributed.

A still further optional object is to decrease symbol and spoke wear through provision of redundant symbols for the most frequently used symbols.

A still further object is to so design the spokes and symbols that their geometry and mechanical characteristics will match the multiple-wheel and high-speed unit characteristics.

A still further object of the invention is to provide microprocessor dynamic lookahead optimization of selection of wheels, character spokes, and open positions (circumferential gaps) so as to further maximize average printing speed.

A still further object is to increase the available repertoire of symbols despite the major speed increase.

Other objects and advantages will be evident from the specifications, claims, and accompanying drawings illustrative of the invention.

DETAILED DESCRIPTION

Figure 1:
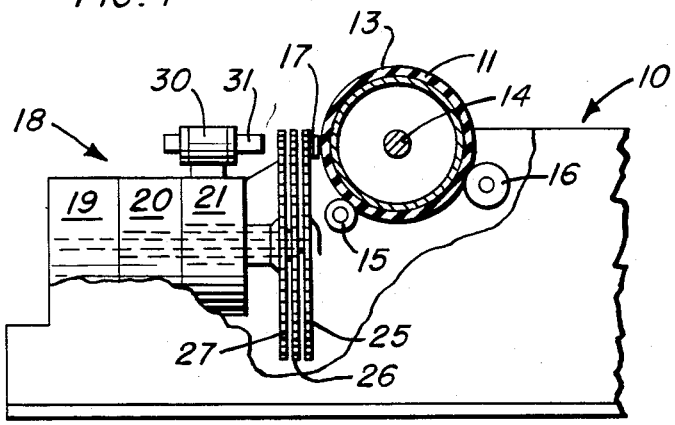
FIG. 1 is a side elevation, partly in section, of the multiple-wheel printer.

A typical printer of the type used with computers or word processing equipment to provide letter quality printing is shown generally at 10 and includes cylindrical platen 11 which holds the paper or form 12 in the printing position. The cushioned face 13 on the platen presents the proper backing of the paper for optimum print quality and quietest operation. The platen is mounted on a shaft 14, all as common in the art. Additional pressure rolls 15 and 16 may be provided to ensure proper paper contact with the platen.

Figure 2:
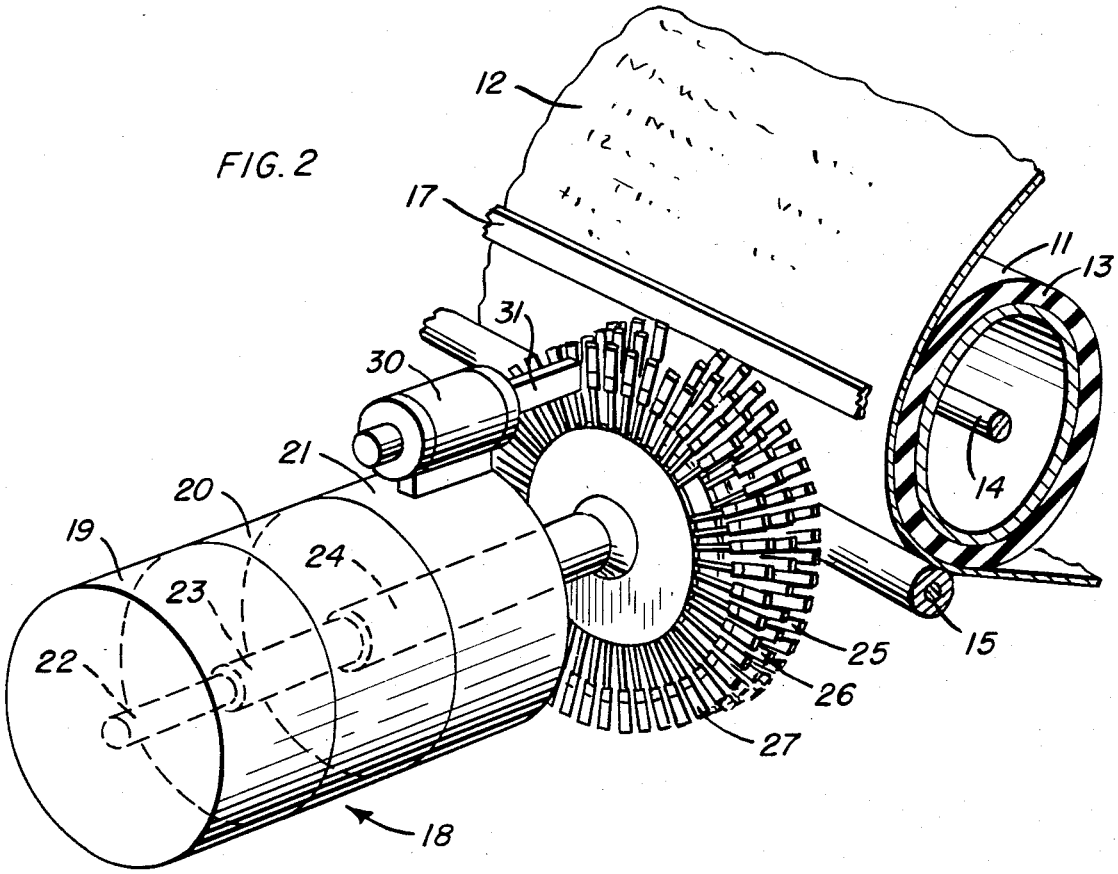
FIG. 2 is a perspective of a three-wheel printer.

A film or fabric inked ribbon 17 extends longitudinally across and is spaced from the platen 11. A special motor unit 18 is mounted within the printer housing and includes three separate (in the FIGS. 1 and 2 embodiment) electric print wheel positioning motors 19, 20 and 21, each of which has an output shaft 22, 23, 24. These shafts are coaxial; two are of course hollow and all are independently rotatable.

A plurality of independent print wheels 25, 26, and 27 are coaxially arranged and each is mounted on a hub in engagement with one of the motor output shafts. For example; motor 19 and shaft 22 drive print wheel 25, motor 20 and shaft 23 drive wheel 26, and motor 21 and shaft 24 drive the rearmost wheel 27. The wheels are as shown substantially parallel to each other.

A solenoid type hammer unit 30 is mounted on motor unit 18 and includes a striker pin 31 which may be rectangular in cross-section and is adapted to impinge upon and press a single petal or spoke against ribbon 17 as is known in the art.

Figure 3:
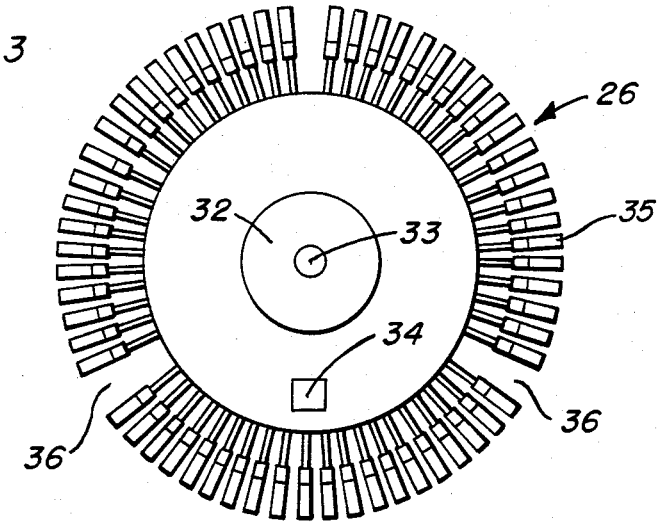
FIG. 3 is a front elevation of a typical spoked print wheel used in my invention.
Figure 5:
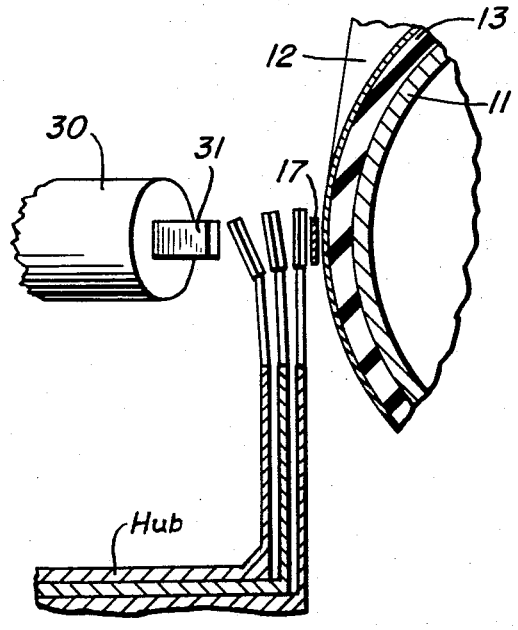
FIG. 5 is an enlarged perspective view showing the relationship of spokes on three different concentric print wheels.

A print wheel 26 is shown in FIG. 3 and includes a mounting hub 32, central shaft opening 33, and a locating member 34. A plurality of individual spokes 35, each carrying a print character adjacent the free end, extend radially from the hub. The wheel may be formed from plastic and/or metal as desired and the individual spokes are resilient so as to return to their original position upon retraction of the striker pin 31. Damping, as well known in the art, is provided. A plurality of gaps 36 are provided in each print wheel to permit either the pin 31 to project through or to permit a spoke from another wheel to move forward as the case may be. It will be noted from FIG. 5 that the spoke ends, bearing the symbols on the respective print wheels, have slightly different angles of inclination with respect to the vertical so that the symbols will impact uniformly against the ribbon 17, paper 12 and platen 13.

Figure 4:
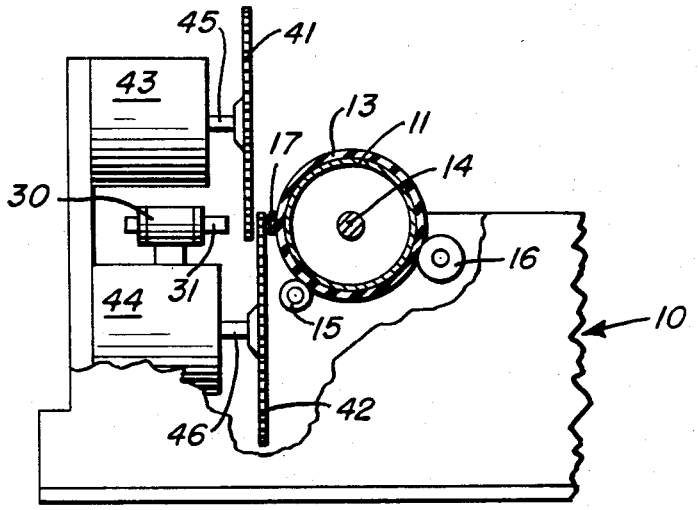
FIG. 4 is a side elevation, partly in section, of a modified multiple motor, multiple print wheel.

In the modified form of the invention illustrated in FIG. 4, the print wheels are not coaxially located but are vertically disposed with print wheel 41 located spaced slightly rearwardly from wheel 42. Each wheel has its own drive motor 43 and 44 also vertically arranged with respect to each other. It will be understood that the letters or other elements on wheel 41 will have to be in proper printing orientation when at the bottom of the circle whereas those on wheel 42 will be in the proper orientation at the top as is conventional. Motor output shafts 45 and 46 connect the wheels to their respective motors. Here again each wheel is provided with a plurality of gaps as in the preferred embodiment. The axes of the motors are shown as parallel and only a single print wheel is shown on each shaft. It will, however, be apparent that the motor axes may be at a slight angle with respect to each other and print wheels may be ganged if desired without departing from the spirit of the invention.

In both forms of the invention each wheel has a diameter of less than 2" and it will be understood by those skilled in the art that other wheel variants are equally feasible.

MODE OF OPERATION

Only that wheel spoke carrying the symbol to be printed is placed at the print position which is, normally, topcenter. A second wheel, or additional wheels, are rotated so as to place a gap or gaps 36 at the print position. Hammer alone, or hammer and spoke, motions take place through such gaps.

Angular accelerations and speeds are 1.6 to 3 times those of print wheels of the known prior art. Optimally distributed, optionally redundant, symbols and multiple wheel openings make possible further substantial reduction of average positioning time but require the use of dynamic lookahead optimization that considers, roughly, the 4 to 6 characters to be printed following the symbol presently being printed.

The processor, which in itself forms no part of this invention, examines the sequence, pre-selects the combination of print spoke wheel, particular printing spoke, and wheel gap positions for each symbol of the sequence, and stores the selection in appropriate registers or buffers. Examples of such operations are given below. For each 64-position print wheel, e.g., a 6-bit group suffices to specify the required angular orientation of the wheel. Twelve or 18 bits would therefore be required for a 2-wheel or 3-wheel configuration, respectively, per symbol for which the positioning is being established. Typically, then, 72 bits would be required for a dual-wheel, 6-symbol lookahead algorithm, or 108 for a three-wheel. In practice, hammerstroke control, line-feed, space, carriage control, and wheel acceleration/deceleration information would be stored in buffers as well.

As each character is printed, and a new symbol to be printed is read from tape, disc, a communications or typing-input buffer, or other source, a new control sequence, corresponding to the composite of "old", unprinted, symbols (typically, 5) and the new member is established; frequently, changes in "routing" will be made.

Hammer action is controlled and will vary both with the proximity of the printing-spoke wheel to the platen and with the identity of the particular symbol. Hammer control to achieve uniform print densities for conventional wheels is well established in the art. Somewhat more complex control is required for multi-wheel configurations, however.

"AND" "Fail-safe" logic separate from the microprocessor prevents hammer actuation should software or hardware errors cause rotation of more than one spoke to the print position just prior to delivery of the hammerstroke impulse by the microprocessor program.

Examples of optimization of wheel symbol assignment and dynamic selection are given below following the descriptions of feasible wheel configurations and related matters.

The descriptions of typical multi-wheel configurations should be considered representative only. Departures in the spirit of the present invention are not excluded by these descriptions and will be apparent to those skilled in the art.

Dual-wheel: Each wheel of a dual-wheel configuration will have an outer diameter of less than 2" as against the present 2.4"-3". Assuming a wheel having a mean thickness and mean density equal to those of current wheels, the weight of each wheel will be roughly $(\frac{2}{3})^2$, or 4/9, of present wheels, while the polar moment of inertia will be about $(\frac{2}{3})^4$ or 16/81, i.e., about 1/5 (one-fifth) of present wheels, at most. (Ricoh wheels, using two intermeshed sets of spokes that are non-coplanar except at the symbol terminations, are inherently heavier at a given overall diameter because of the thicker hub; the moment of inertia of such wheels, at the present 2.4" diameter, exceeds that of an equivalent potential monoplanar 2.4" configuration.)

In actuality, the mean thickness of the wheels of this invention will be less than that of current wheels. That lower thickness and the presence of a number of circumferential gaps in each wheel will further reduce overall weight and moment of inertia. Accordingly, the ratio (0.2) of estimated moment of inertia of each wheel, of a 2" diameter multi-wheel configuration, to the moment of a current 3" wheel of similar composition should be viewed as an upper limit. Polar moments of inertia will decrease more drastically for wheels below 2".

There will be, as compared with 88 to 96 symbols in most current wheels (Ricoh: 124), typically 60 potential symbol (spoke) positions per wheel (of a dual), or a total of about 120 (as discussed more fully below). However, a number of spoke positions will be unoccupied (typically four or more, yielding about 56 spokes) and will form the gaps through which the hammer, an active spoke, or both, can pass during a print cycle or through which the printed characters may be viewed. Useful configurations are described below.

Specifically, a present single-wheel reading gap (U.S. Pat. No. 3,949,853) subtends an arc (30°, arc length about 0.785"=1.994 cm.)—somewhat greater than needed to provide read-through. In the present invention one or more—generally three per wheel—gaps are provided, each gap occupying several spoke positions, primarily for printing purposes, each consisting (minimally) of two (2) spoke-free positions. Each gap normally occupies, therefore, a 0.200" (0.508 cm.) arc at the periphery—slightly less at the print centerline. However, by circumferentially abutting, dynamically, two or more such gaps at an adequate frequency, an effective viewing gap of 0.400" (1.016 cm.) or more can be created on operator demand. All wheels must of course present gaps simultaneously for this purpose. Such actions will cause minor speed losses; the operator should therefore be able to elect or reject this option and to control gap positioning frequency and effective total width for this (readthrough) purpose.

Triple-wheel: Each wheel of a three-wheel configuration (FIGS. 1,2) will have an outer diameter varying between about 1.35" (3.43 cm.) and 1.8" (4.57 cm.). The weight of each wheel will therefore be at most between about 0.2 and 0.4 of present wheels, while the polar moment of inertia will be at most between 0.05 (1/20) and 0.13 (1/7.7) of present wheels.

There will be between 48 and 60 spoke positions per wheel of a triad, including 4 or more empty positions, yielding between about 36 and 56 spokes per wheel; specific useful configurations are described below.

Two and Three Wheel Configurations

Throughout the balance of the text, the designations AB and ABC are used to mean, respectively, a 2-wheel configuration in which wheel A is nearer the platen, a 3-wheel in which wheel A is nearest the platen, etc. These correspond to wheels 25, 26, 27 in FIGS. 1 and 2.

The following list summarizes the salient characteristics of an AB with an outer diameter of 1.910" (4.851 cm.) (For all configurations, the centerline-centerline distance at the outer diameter, between successive spoke positions, is taken as 0.1000" (0.2540 cm.); this is intermediate between Qume/Xerox and Ricoh.):

The total number of spoke positions, L, is 120. Of the 120, 108 spokes are actually present. There are:

54 spokes per wheel, distributed among
3 sets of
18 spokes each (on average), each pair of sets separated by 1 gap consisting of:
2 open positions; there are therefore
6 open positions per wheel, for a total of
12 unoccupied positions in the configuration.

It is noted that if the outer diameter is increased to 2.000" (5.080 cm.), 63 potential spoke positions per wheel are available, or a total of 126. If a total of 12 open positions is again provided, 114 actual spokes are present at that 2.000" diameter.

It is stressed that the gaps are not necessarily uniformly distributed; in fact, an initial study indicates that each of two of the wheel A gaps should border the central cluster of 13 symbols centered on "e" (see the discussion, below, of symbol assignments). The centerlines of those gaps are separated by 90°. Placement of the third gap is not now determined; that gap may be diametrically opposite the "e", i.e., at 135° from each of the first two.

Specific lower case letter assignments are discussed below following the description of practical ABC configurations; locations of other symbols are much less critical and are merely touched on in this application. It is to be understood that a homogeneous set of symbols or characters is utilized, which characters or symbols are distributed among the print wheels in an optimum fashion.

The following lists summarize the salient characteristics of two ABC configurations.

The first incorporates three 1.337" (3.396 cm.) diameter wheels, the second, offering a different speed/symbol aggregate tradeoff, three 1.720" (4.369 cm.) wheels.

The parameters of the first (1.337") ABC are the following:

The total number of spoke positions, L, is 126. Of the 126, 108 spokes are actually present. There are:

36 spokes per wheel, distributed among
3 sets of
12 spokes each (on average), each pair of sets separated by 1 gap consisting of:
2 open positions; there are therefore
6 open positions per wheel, for a total of
18 unoccupied positions in the triad.

The diameter, 1.337", is very small. The entire wheel is only slightly larger than the present Qume hub (for example). Certain mechanical/geometrical problems exist for wheels of that diameter.

Accordingly, a second ABC configuration is now described, but the 1.337" configuration is not precluded.

A 1.72" diameter ABC triad includes a total, L, of 162 spoke positions. Of the 162, 144 spokes are actually present. There are:

48 spokes per wheel, distributed among
3 sets of
16 spokes each (on average), each pair of sets separated by 1 gap consisting of
2 open positions; there are therefore
6 open positions per wheel, for a total of
18 unoccupied positions in the triad.

The 144 spokes provide 36 symbols beyond the 108 provided by either AB (at the 1.910" diameter) or ABC (at 1.337"). 144 substantially exceeds the number, 124, provided by the Ricoh wheel.

In either ABC configuration, it may be found desirable to reduce the number of B gaps to 2 (4 open positions) and C gaps to 2 or 1 (4 or 2 open positions), increasing the number of symbols by 4 or 6.

Symbol Assignments

The AB and ABC lower case letter assignments presented here are the results of limited initial studies. They are, therefore, not fully representative of the optimal results of which these configurations are capable, particularly when they incorporate optimally placed gaps and redundant letters.

With respect to such redundant letters, a part of the table entitled "Statistical Usage of 37 Characters in Average English" is reproduced here from FIG. 3 of U.S. Pat. No. 3,949,853.

| Character | Usage per 1000 |
|---|---|
| e | 118 |
| t | 90 |
| a | 78 |
| o | 73 |
| n | 70 |
| i | 70 |
| s | 59 |
| r | 58 |
| h | 52 |
| l | 39 |
| d | 36 |
| c | 28 |
| u | 27 |
| m | 24 |
| f | 22 |

Total occurrences of the 15 letters "e" though "f" above constitute 844 of 1,000 occurrences of all symbols—a very high fraction. Total occurrences for the subset "e" through "u" constitute 798 of 1,000—virtually 80%.

Accordingly, the assignment of letters to the spokes of the single wheels of current commercial printers reflect such statistics; to the extent practicable, high-frequency letters are clustered to minimize mean rotation time. Such clusterings reflect computer studies involving both single-symbol and multiple-character occurrence frequency statistics—U.S. Pat. No. 3,949,853, for example.

The present invention, however, provides an advantageous trade-off between higher speed and greater total numbers of spokes, thus enabling provision of either very great increase in speed—for the smallest wheels—with little increase in numbers of distinct characters, at a wheel diameter less than 2"; or a more moderate speed increase, with a substantial increase in numbers of distinct characters at a wheel diameter of about 2.0".

The numerical details of the trade-off will vary with the number of wheels in the elected multi-wheel configuration and with other factors—whether, for example, symbols of certain widths are clustered in "zones" to facilitate provision of the proportionately-printing wheels of the prior art.

Despite these limitations, the symbol distributions presented here yield total spoke positional displacement times, for samples of normal English text, between 30% and 50% shorter than those required by standard wheels.

Wheel mean angular speed will well exceed that required to maintain proportionality between that speed and the larger angular displacement, per spoke position, for the smaller wheels.

The "total printing times" are then conservatively estimated on the basis of the assumption of a linear relationship between a required total angular displacement and the corresponding rotational period. The latter is measured in "Time Units". A Time Unit (abbreviated, singularly or plurally, "TU") is defind as the time required for the wheel to rotate through one spoke angular interval (inclusive of acceleration and deceleration).

Hammer actuation periods are not included.

It is noted that when any wheel configuration is optimized for the English language, it is not necessarily optimized for any other language using the same basic alphabet.

The tentative, AB, lower case nonredundant letter assignment is shown in Table I.

TABLE I

| Spoke Index | Qume | Xerox | Ricoh | A | B |
|---|---|---|---|---|---|
| −1 | # | q | # | | |
| 0 | w | z | u | | |
| 1 | z | x | # | | |
| 2 | y | k | b | | |
| 3 | k | b | z | | |
| 4 | q | p | d | | |
| 5 | u | y | v | — | w |
| 6 | p | g | k | — | z |
| 7 | f | v | g | f | y |
| 8 | s | u | n | s | k |
| 9 | h | c | c | h | q |
| 10 | t | h | s | t | u |
| 11 | i | d | p | i | p |
| 12 | a | a | r | a | — |
| 13 | e | e | e | e | — |
| 14 | n | n | t | n | d |
| 15 | r | o | o | r | x |
| 16 | o | r | f | o | g |
| 17 | c | w | h | c | v |
| 18 | b | t | i | b | j |
| 19 | l | # | a | l | m |
| 20 | d | s | y | — | |
| 21 | x | # | l | — | |
| 22 | g | j | w | | |
| 23 | v | m | # | | |
| 24 | j | i | m | | |
| 25 | m | # | # | | |
| 26 | # | f | x | | |
| 27 | # | # | j | | |
| 28 | # | l | q | | |

In this table the wheel is viewed clockwise looking toward the platen from the wheel, following sequentially from the top of the table to the bottom. For comparison purposes, the Qume, Xerox, and Ricoh wheel distributions are shown as well. The several distributions are aligned so that the letter "e" occurs at the same position for the single wheels and for wheel A of AB. The symbol "#" is substituted, in the figure, for any symbol other than a lower case letter. The symbol "---" denotes an open position, i.e., a spoke-free gap. Blanks in the "A" & "B" columns represent positions now unassigned.

Three points are made:

1. The AB selections of my specification are simply segments from the Qume sequence. The 13 central symbols of the Qume are bounded by gaps in A. The remaining 13 letters are moved to B and split into groups of 6 and 7 letters centered, as far as practicable, on their dividing gap. The rationale here, after some study, was simply to accept the computerbased Qume distribution as the foundation. This has the important advantages of ensuring "local" (within-group) optimization and providing, as well, an excellent basis of speed comparison with an established print wheel. The Xerox distribution is constrained by geometry considerations arising from the requirement for proportional spacing; U.S. Pat. No. 3,949,853 indicates that there is about a 5% speed loss vs. Qume. The Ricoh distribution rationale is not indicated in the Ricoh patents (U.S. Pat. Nos. 4,106,611 and 4,126,400); the assignment is presumably based on computer studies reflecting the needs of several West European languages, since a number of modified lower case letters are incorporated in the Ricoh complete sequence.

2. Preliminary results indicate that redundant "e"'s and "t"'s, if incorporated in A, must be inserted only on the basis of extensive simulation to ensure a net speed increase; the offsetting effect of greater average distances among the "f" through "l" central Qume letters tends to negate the greater accessibility of "e" and "t". Additions of those letters to B, however, are almost invariably favorable. Even if redundant-letter additions to A and/or B (or C in a triad) were to increase speed merely marginally, however, such additions would substantially reduce wear rates of the letters "e", "t", etc., and their spokes and would therefore be highly desirable in any case.

3. It is probable, on the basis of initial studies, that placement of the letter "m" substantially closer to "e" would enhance wheel performance in general.

It is stressed that redundancy—particularly of "e"'s and "t"'s—is practical. When several trial symbol AB (and ABC) assignments incorporating such redundancy were studied briefly, however, it was determined that the combination of high sensitivity of the results of precise placements and relatively small speed improvements did not warrant introduction at this time.

The distribution displayed in Table I is one of several that offered roughly comparable performances. The position of the B gap between "p" and "d", for example, is not critical. If that were shifted, however, it would be by moving it toward "u".

As an example, one text sample involved the aberrant, but well-known, 35 letter sentence, "The quick brown fox jumps over the lazy dog." This contains 4 37 o"'s, 3 "e"'s, and 2 each of "t", "r", "h", and "u". The statistically expected respective numbers of those letters per average sequence of 35 are 2.6, 3.8, 3.2, 2.0, 1.8, and 0.95. However, it is otherwise very abnormal, in that the remaining 20 letters of the sentence comprise precisely the remaining 20 letters of the alphabet.

The result: AB requires 194 TU, Qume 277. (The Qume angular increments are 3.75° rather than the 6° of A or B.)

The improvement over Qume is 30%—again, without considering wheel rotational speed differences. This result is atypical, reflecting the unusual presence of substantial percentages of low-frequency letters. More nearly typical sentences yield spoke motion decreases of the order of 27½%; this is representative.

Wheel actions for a few of the letters of "The quick brown fox . . . " are illustrated as follows: Assume the letter "b" has just been printed, from A; spoke 18 (see Table I) is therefore in the print location (top center). Wheel B is at position 12.5, that is, the gap between "p" and "d" in B is also at the top center position. The operations continue as indicated immediately below; the numbers in the last two columns are the numbers of spoke increments required to place symbols, or gaps, at the successive print locations:

| | SPOKE POSITION | | SPOKE INCREMENT | |
|---|---|---|---|---|
| LETTER | A | B | A | B |
| r | 15 | 12.5 | 3 | 0 |
| o | 16 | 12.5 | 1 | 0 |
| w | 20.5 | 5 | 4.5 | 7.5 |
| n | 14 | 12.5 | 6.5 | 7.5 |
| f | 7 | 12.5 | 7 | 0 |
| o | 16 | 12.5 | 9 | 0 |
| x | 20.5 | 15 | 4.5 | 2.5 |

Since at each step the number of time units required is the greater of the A and B TU required, the total TU for this sequence is 3+1+7.5+7.5+7+9+4.5, or 39.5. In comparison, Qume execution of the same sequence requires a total of 55 TU.

The difference arises because the Qume increments are 3, 1, 16, 14, 7, 9, and 5. Thus, the savings occur at the third, fourth, and last steps. The major gains reflect quick accessibility of the letter "w" in wheel B. A small price must be paid—the required redeployment of B to the 12.5 gap after "w" has been printed. Even so, the time required (6.5 TU) to reposition A to the "n" position after A had been positioned to the 20.5 gap—for "w" printing—is totally masked, i.e., it is less than the time (7.5) required to bring B back to the 12.5 position and so does not add to the total TU.

When "w" is to be printed, wheel A is rotated, as noted, to the 20.5 gap; this is chosen instead of the 5.5 gap because the letters "n", "f", and "o" follow. If gap 5.5 had been selected, the A spoke increments, beginning with the letter "w", would be 10.5, 8.5, 7, 9, and 4.5. The total TU required would be 43.5 instead of 39.5. Selection of the 20.5 gap position when "w" is printed from wheel B saves a total of 4 TU.

Microprocessor lookahead by at least four (4) letters is clearly required in this simple example. If additional letters affect the minimizations, or if redundant letters are present, the decision process will involve longer lookaheads.

The tentative ABC lower case nonredundant letter assignment is shown in Table II. Again, the Qume is the foundation.

TABLE II

| ABC Lower Case Letter Assignments | | | |
|---|---|---|---|
| SPOKE INDEX | A | B | C |
| 6 | | | w |
| 7 | — | | z |
| 8 | — | | y |
| 9 | h | p | k |
| 10 | t | f | q |
| 11 | i | s | u |

TABLE II-continued

| ABC Lower Case Letter Assignments | | | |
|---|---|---|---|
| SPOKE INDEX | A | B | C |
| 12 | a | — | — |
| 13 | e | — | — |
| 14 | n | b | g |
| 15 | r | l | v |
| 16 | o | d | j |
| 17 | c | x | m |
| 18 | — | | |
| 19 | — | | |

In comparison with AB (Table I), the letters s, f, b, and l have been shifted from A to B and the letters u through w and g through m from B to C. The asymmetric assignment of letters around the 12.5 gap of C is deliberate; the moderately—high frequency "u" and "g" are both placed next to the 12.5 gap of C.

Any triple-wheel printing action requires alignment of two gaps and the desired spoke. Printing of a "p", for example, requires alignment at top center of the 7.5 or 18.5 gap of A (or a third one in some unspecified location), some gap (e.g., the 12.5 gap) of C, and the spoke at index 9 of B. The actions are simple extensions of the operations previously outlined for the AB configuration.

Analysis of the actions required for the "The quick brown fox . . . ", assuming an initial placement of spoke 13 of A ("e") at top center, as well as the 12.5 gaps of B and C, yields a total of 135 TU—to be compared with 194 for AB and 277 for Qume. The ABC figure is 49% of Qume and 70% of AB. Again, this reduction does not reflect the much higher rotational speeds of the ABC wheels vs. those of the current art.

The 51% reduction of spoke positional increments required, from the Qume, is abnormally high, reflecting again the peculiar characteristics of the sentence selected.

A second example is that of the very normal 46 letter text, "When in the course of human events it becomes necessary". In this case, wheel A is assumed to be set to spoke index 13, "e", and B and C to the gaps 12.5 and 12.5 before initiation of the print sequence and after completion. A total of 168.5 TU is required for ABC vs. 271 for Qume.

In this case, despite the fact that 32 letters are printed from A, including the second through eleventh without interruption, and only 7 from each of B and C, ABC requires 38% fewer spoke incrementations than Qume.

Lookahead to a depth of 5 or 6 letters is required at several points to determine the best A gap selection—for example, when "u" in "human" is printed at step 19 from C. The sequence of letters "manev" following the "u" is considered and the determination made that the choice of the 18.5 gap at step 19 would be incorrect; it would require 4 more TU than use of the 7.5 gap.

It will be apparent that any homogeneous subset of symbols, consisting of uppercase letters, lowercase letters, digits, foreign letters or the like may be distributed among the several print wheels for optimization of printing speed in certain uses without departing from the spirit of this invention.

Figure 6:
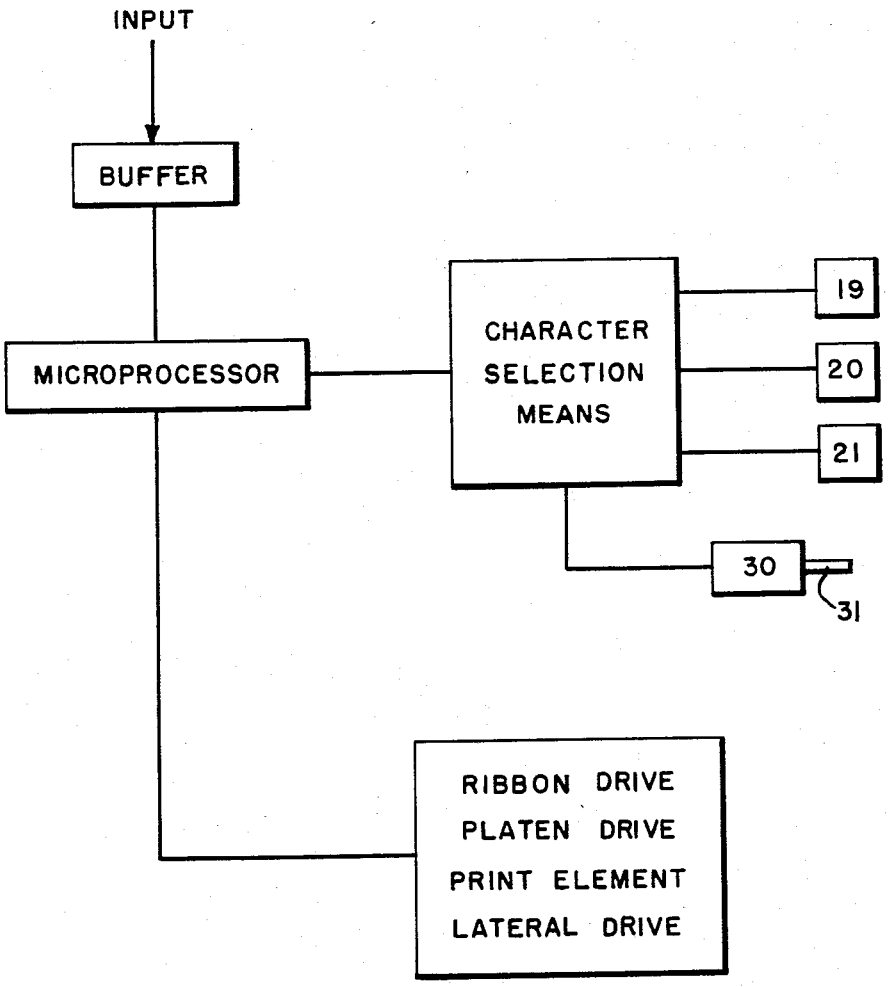
FIG. 6 is a schematic diagram of the printer control circuit.

As shown in FIG. 6, data from a keyboard or other input device passes into the printer memory buffer. The microprocessor serves to control the print wheel assembly lateral drive, the platen rotation, and ribbon feed, all as conventional in the art. Additionally, it performs a lookahead function as known in the art to actuate the character selection means and to select the most efficient positioning of gaps and characters resulting in the minimum possible print wheel rotation as noted above. Any sequence of successive sets of wheel positions may be termed a chain. Beginning with the current set of wheel positions, that is, the set chosen to print the current symbol, all possible chains are considered in the lookahead, terminating inclusively at the last of the next "n" symbols, where "n" is the lookahead number of succeeding symbols to be printed, such that each and every set in the chain places just one symbol, namely the one to be printed at that stage in the chain, at the print angular position. That set of wheel positions is selected as the one to follow the current one, which is the second in that chain that requires the lowest total transition time, from the current symbol to the last in the lookahead sequence. That second set then becomes the current symbol set, another symbol is added to the lookahead sequence and the entire process is repeated. It will be understood that a transition time is the time that it takes for the wheel undergoing the largest rotation to arrive at its next position.

The character selection means controls the motors 19, 20, and 21 for individual print wheels and also actuates the hammer unit 30 when each of the wheels is in proper position.

I claim:

1. In a high speed line printer having a platen, a print element assembly, and hammer means for moving a selected print element of the print element assembly toward the platen, the improvement comprising; said print element assembly consisting of a plurality of individual print wheels axially fixed with regard to said platen, each wheel having a plurality of radial character carrying spokes, said wheels being axially spaced from each other, separate electric motors for each print wheel adapted to rotate its respective wheel so that a selected spoke is in alignment with the hammer means for actuation thereby, at least one radial gap between a pair of spokes in each print wheel, said gaps of all but the wheel closest to said hammer means having at least a width of one spoke and adapted to allow entry therethrough of either the hammer means or a spoke from a successive spaced print wheel, the wheel closest to said hammer means having a gap width sufficient to allow passage therethrough of said hammer means, character selection means for selectively actuating one or more of the motors for rotating its associated print wheel to align a selected spoke on one wheel with the hammer means and gaps on the remaining wheel or wheels with the hammer means, and means for actuating the hammer means to drive the selected spoke to impact the character thereon against the platen to effect printing.

2. A high speed printer as defined in claim 1 wherein the print wheels are coaxialy located.

3. A high speed printer as defined in claim 2 wherein said separate motors are coaxially arranged, drive shaft means extending from each motor, at least one of the drive shaft means being hollow, said print wheels each being mounted on one of said drive shaft means for rotation therewith.

4. A high speed printer as defined in claim 1, wherein the print wheel furthest from said platen has at least one radial gap and each of the remaining print wheels has a plurality of gaps.

5. A high speed printer as defined in claim 1, wherein each print wheel has a separate axis of rotation, said axes being spaced apart and substantially parallel and wherein a character on a spoke of one print wheel and a gap on another print wheel lie on a line from the hammer means normal to the platen.

6. A high speed printer as defined in claim 5, wherein the motors for the print wheels are vertically spaced with respect to each other and each has a drive shaft mounting a respective print wheel for rotation therewith, said drive shafts being substantially parallel to each other.

7. A high speed printer as defined in claim 1, wherein at least some of the characters on the print wheels are replicated and such replicated characters are distributed among the plurality of print wheels.

8. A high speed printer as defined in claim 1, wherein at least some of the characters on the print wheels are lowercase letters and are distributed among the plurality of print wheels.

9. A high speed printer as defined in claim 1, wherein at least some of the characters on the print wheels comprise a selected subset of symbols and are distributed among the plurality of print wheels.

10. A high speed printer as defined in claim 1 and further including buffer means to store preselected characters to be printed and microprocessor means adapted to lookahead of the character being printed to control the character selection means to choose the particular character to be printed next and wheel gaps which requires the minimum of print wheel rotation in the case of replicated characters.

11. In a high speed printer as defined in claim 1, wherein said print element assembly comprises three print wheels.

12. A print element assembly for use in a high speed line printer comprising, a plurality of individual print wheels axially fixed with respect to each other, each wheel including a plurality of radially directed spokes, each spoke carrying a print character face thereon, said wheels being axially spaced from each other, separate electric motors for each of said print wheels for rotating the wheels so that a selected spoke is brought into a printing position for actuation by a print hammer, at least one radial gap between a pair of spokes in each print wheel, said gaps of all but the wheel closest to said print hammer having a width at least equal to one spoke and adapted to allow entry therethrough of either the print hammer or a spoke from a successive spaced print wheel, the wheel closest to said print hammer having a gap width sufficient to allow passage therethrough of said print hammer.

13. A print element assembly as defined in claim 12, wherein the print wheels are coaxially located.

14. A print element assembly as defined in claim 13, wherein the spoke ends of the print wheel furthest from the motors are substantially planar with the remainder of the spoke, and the spoke ends of the remaining print wheels are bent rearwardly at a small angle toward said motors.

15. A print element assembly as defined in claim 13, wherein said motors are coaxially arranged, drive shaft means extending from each motor, at least one of the drive shaft means being hollow, said print wheels each being mounted on one of said drive shaft means for rotation therewith.

16. A print element assembly as defined in claim 15 wherein each of the print wheels except that which is closest to said motors has a plurality of radial gaps.

17. A print element assembly as defined in claim 12, wherein at least some of the characters on the print wheels are replicated and are distributed among the plurality of print wheels.

18. A print element assembly as defined in claim 12, including three print wheels.

19. A print element assembly as defined in claim 12, wherein the diameter of each print wheel is less than two inches.

* * * * *